US005145384A

United States Patent [19]

Asakawa et al.

[11] Patent Number: 5,145,384

[45] Date of Patent: Sep. 8, 1992

[54] ELECTRICAL CONNECTOR AND TERMINAL THEREFOR

[75] Inventors: Kazushige Asakawa; Minoru Fukushima, both of Yokohama; Mitsuo Fujikura, Zama, all of Japan

[73] Assignee: Molex Incorporated, Lisle, Ill.

[21] Appl. No.: 736,885

[22] Filed: Jul. 29, 1991

[30] Foreign Application Priority Data

Sep. 10, 1990 [JP] Japan ..... 2-095026[U]

[51] Int. Cl.[5] ..... H01R 9/09

[52] U.S. Cl. ..... 439/78; 439/83; 439/81; 439/876

[58] Field of Search ..... 439/78–83, 439/876

[56] References Cited

U.S. PATENT DOCUMENTS

| | | | |
|---|---|---|---|
| 4,351,582 | 9/1982 | Emerson et al. | 339/97 |
| 4,738,631 | 4/1988 | Takahashi et al. | 439/248 |
| 4,773,877 | 9/1988 | Kruger et al. | 439/482 |
| 4,815,982 | 3/1989 | Sadig-Behzadi | 439/82 |
| 4,955,820 | 9/1990 | Yamada et al. | 439/83 |
| 4,969,829 | 11/1990 | Sato | 439/83 |
| 4,978,307 | 12/1990 | Billman et al. | 439/83 |
| 5,030,107 | 7/1991 | Moon | 439/78 |
| 5,037,316 | 8/1991 | Fukushima et al. | 439/83 |
| 5,057,027 | 10/1991 | Yamada et al. | 439/83 |

FOREIGN PATENT DOCUMENTS 2106882 4/1990 Japan .

*Primary Examiner*—Paula A. Bradley

*Attorney, Agent, or Firm*—Charles S. Cohen; Stephen Z. Weiss

[57] ABSTRACT

An electrical contact is disclosed for use in an electrical connector to be surface mounted to a printed circuit board. The contact includes an inverted U-shaped portion defining a pair of depending legs. One of the legs has a foot portion for electrical connection to an appropriate circuit trace on the printed circuit board. A terminal portion is turned upwardly from a distal end of the other leg for termination with an appropriate mating terminal. The contact is in the form of a one-piece metal component. In the preferred embodiment, the terminal portion of the contact is in the form of a terminal pin, with the pin and the legs of the inverted U-shaped portion of the contact all being generally parallel.

22 Claims, 3 Drawing Sheets

ELECTRICAL CONNECTOR AND TERMINAL THEREFOR

FIELD OF THE INVENTION

This invention generally relates to the art of electrical connectors and, particularly, to an electrical connector which incorporates a novel terminal and, more specifically, to a surface mounted electrical connector and a terminal for terminating to a printed circuit board or the like.

BACKGROUND OF THE INVENTION

As is known, many electrical components are designed for mounting to a printed circuit board, as by soldering the lead terminals of the electrical component to the surface of the printed circuit board or by connecting them to the surface of the printed circuit board with the aid of lead-less means. The quality with which the electrical components are electrically connected to the printed circuit board depends greatly on the shape of the lead terminal, as well as the soldering condition resulting from the particular shape of the terminal. Therefore, efforts constantly are being made to design improved lead terminal shapes to improve the overall connection of electrical components to printed circuit boards. For instance, some degree of yielding or flexibility is desired in the terminals as well as between the electrical components and the printed circuit board to relieve stresses at the soldering connections.

This invention is directed to satisfying the need for new and improved surface mounted terminals and electrical connectors of the character described.

SUMMARY OF THE INVENTION

An object, therefore, of the invention is to provide a new and improved terminal for use in a surface mounted electrical connector.

Another object of the invention is to provide a new and improved electrical connector incorporating the terminal of the invention.

In the exemplary embodiment of the invention, the terminal is provided in the form of an electrical contact for use in an electrical connector to be surface mounted to a printed circuit board. The contact includes an inverted U-shaped portion defining a pair of depending legs. One of the legs has a foot portion for attachment to an appropriate circuit trace on the printed circuit board. A terminal portion is turned upwardly from a distal end of the other leg for termination with an appropriate mating terminal.

In the preferred embodiment of the invention, the electrical contact comprises a one-piece component of stamped metal material. The terminal portion of the contact is in the form of a terminal pin for mating with a complementary terminal receptacle. The terminal pin and the legs of the inverted U-shaped portion of the contact are generally parallel. The pin has a plurality of barbs at the base thereof for staking the contact into an appropriate dielectric housing of the electrical connector. The foot on the one leg of the U-shaped portion has a generally flat bottom surface for surface mounting to the circuit trace of a printed circuit board.

The invention contemplates an electrical connector including a dielectric housing having at least one terminal receiving socket means for receiving the electrical contact described above. The terminal pin portion of the contact is mounted in the dielectric housing generally snug or rigid with the housing. In one form of the invention, the terminal pin portion projects freely into the socket means for termination with an appropriate mating female terminal. The inverted U-shaped portion of the contact is mounted in the socket means generally freely to provide resiliency not only between the contact and the dielectric housing but between the connector and the printed circuit board.

In alternate forms of the invention, the dielectric housing has wall means against which the terminal pin portion of the electrically contact is disposed. A contact portion of an appropriate mating terminal is inserted into the socket means for engaging the terminal pin portion on a side thereof opposite the wall means of the housing. In other words, the wall means provides a backing support for the terminal pin portion in a transverse direction when engaged by the mating terminal. In these embodiments, the mating terminal is not a female terminal, but a complementary mating terminal pin.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularly in the appended claims. The invention, together with its objects and the following description taken in conjunction with the accompanying drawings, in which like reference numerals identify like elements in the figures and in which:

DETAILED DESCRIPTION OF THE PREFERRED EMBODIMENT

Figure 1:
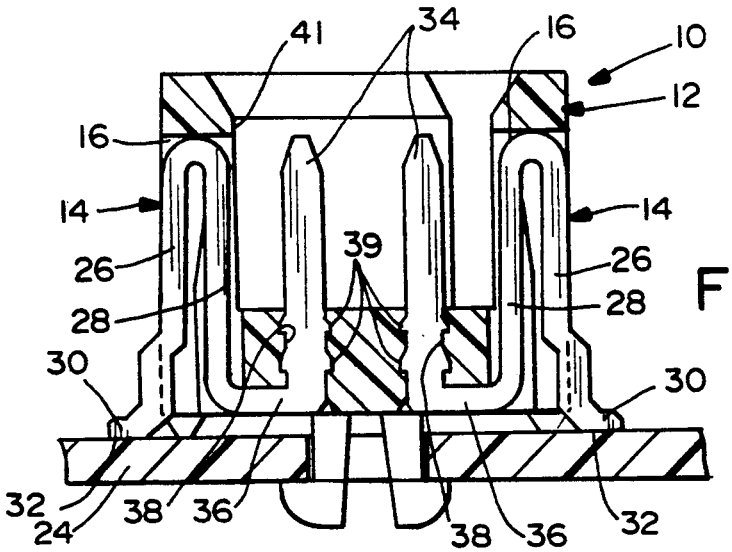
FIG. 1 is a vertical section through an electrical connector incorporating the novel electrical contact of the invention.

Referring to the drawings in greater detail, and first to FIG. 1, an electrical connector, generally designated 10, is disclosed to include an elongated dielectric housing, generally designated 12, having a pair of electrical terminals or contacts, generally designated 14, mounted therein. The contacts are identical except for their opposite orientations as shown in the depiction. Dielectric housing 10 includes socket means 16 within which contacts 14 are mounted.

Figure 2:
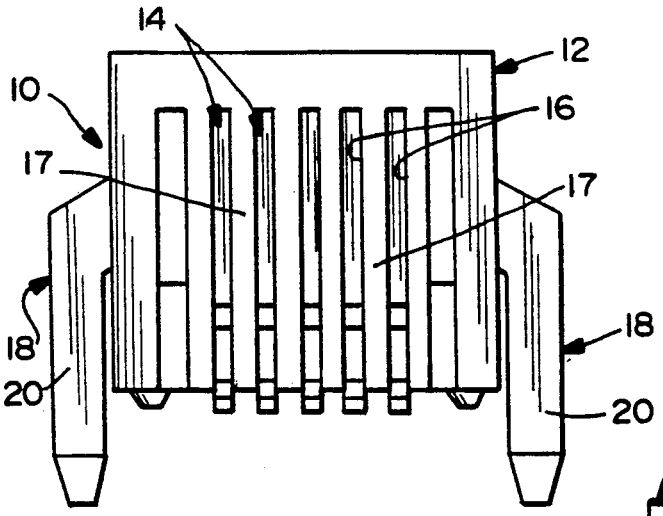
FIG. 2 is a fragmented front elevational view of the connector.

As seen in FIG. 2 in conjunction with FIG. 1, each socket means 16 comprises a slot in dielectric housing 12 opening to the front or the rear thereof. FIG. 2, along with FIGS. 3 and 4, also shows that connector 10 is a multi-terminal connector which is elongated and has a series of socket means 16 spaced lengthwise thereof, each socket means being provided for receiving a pair of contacts 14 as shown in FIG. 1. Each socket means or slot 16 is separated by a thin wall 17 (see FIGS. 2 and 4) of the housing.

Figure 5:
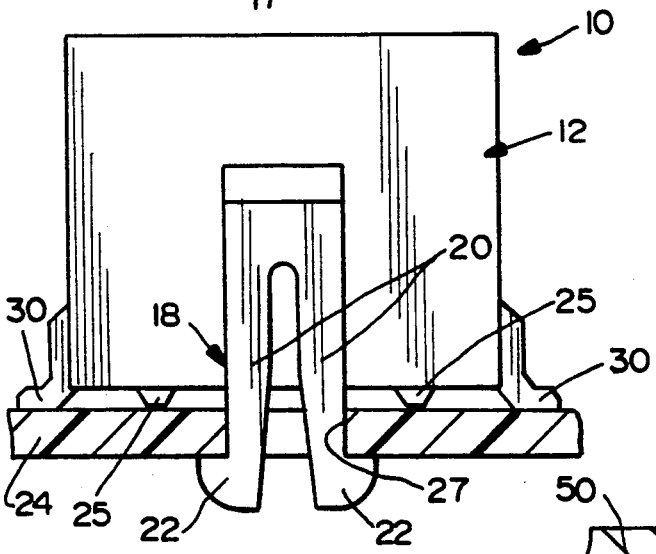
FIG. 5 is a side elevational view of the connector.

Dielectric housing 12 is integrally molded of plastic material or the like. As seen best in FIG. 5, each opposite end of the housing is provided with a bifurcated mounting peg, generally designated 18, which includes a pair of pegs 20 having hook portions 22 at the distal ends thereof for surface mounting connector 10 to a printed circuit board 14. Bifurcated peg 18 is integrally molded with the housing. When bifurcated peg 18 is inserted into a hole 27 in printed circuit board 24, legs 22 yield inwardly toward each other. When the peg is fully inserted into the board, hook portions 22 snap outwardly to lock under the board. Integral spacer bosses 25 also may be molded integrally with the bottom of the housing for engaging the top of the printed circuit board to space the connector slightly therefrom.

Referring back to FIG. 1, each contact 14 is fabricated as a unitary or one-piece terminal of stamped metal material. Each contact has an inverted U-shaped portion defining a pair of depending legs 26 and 28. The U-shaped portion is fairly freely mounted within socket means 16, so that legs 26 and 28 can flex and provide a spring means for the contact.

Leg 26 has a foot portion 30 at the bottom distal end thereof for electrical connection to an appropriate circuit trace on printed circuit board 24. In the preferred embodiment, foot 30 has a generally flat bottom surface 32 for surface mounting to the circuit trace.

Each contact 14 also includes a terminal portion 34 turned upwardly from a distal end from leg 28, as by a bridging portion 36 of the contact, whereby the upper end of terminal portion 34 is freely exposed within housing 12, as described hereinafter, for termination with an appropriate mating terminal. In the preferred embodiment of the invention, terminal portion 34 is in the form of an upwardly directed terminal pin, as shown, projecting upwardly through a hole 38 in dielectric housing 12. Barbs 39 are provided on the outside of the pin for staking the terminal rigidly within hole 38 of the housing.

From the foregoing, it can be seen that foot 30 on the bottom of leg 26 of contact 14 is rigidly fixed to printed circuit board 24 as by soldering, and terminal portion 34 of the contact is rigidly fixed to housing 14 by staking in hole 38 of the housing. Consequently, the inverted U-shaped portion of the contact, defined by legs 26 and 28, provides a spring means between the fixed foot and the fixed terminal portion. This unique construction not only provides for flexibility in the contact itself, but the design allows the entire electrical connector, including housing 12, to yield relative to printed circuit board 24. This yielding or resiliency in the connector relieves stresses on the electrical connections between the contacts and the printed circuit board, such as the soldering connections between bottom surfaces 32 of feet 30 and the circuit traces on the printed circuit board. In addition, walls 17 (FIGS. 2 and 4) of the housing are sufficiently thin to allow limited movement of the inverted U-shaped portions of the terminal longitudinally of the connector. For instance, the walls may be on the order of 0.2 inch thick.

Figure 3:
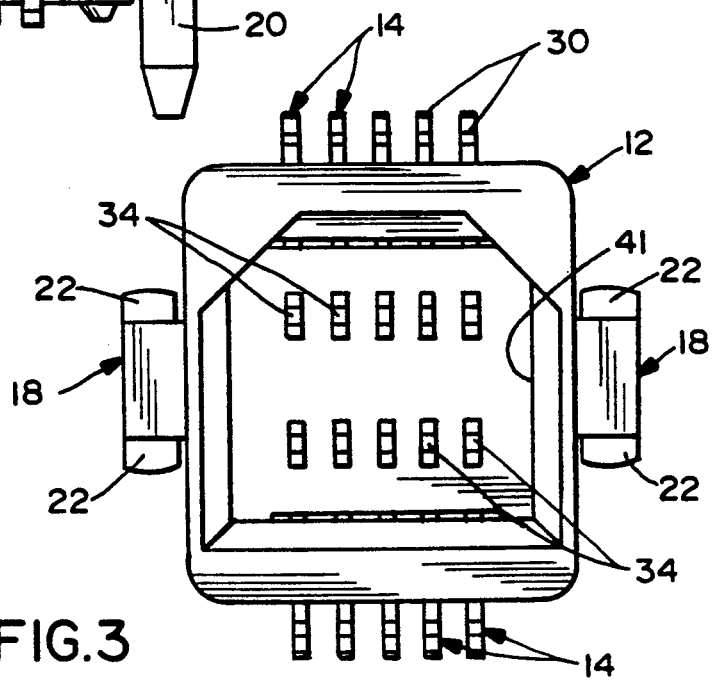
FIG. 3 is a fragmented top plan view of the connector.
Figure 4:
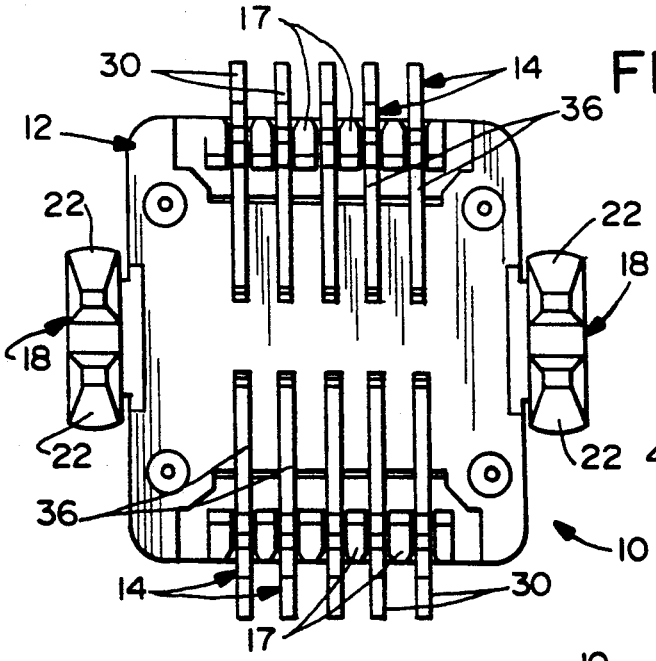
FIG. 4 is a fragmented bottom plan view of the connector.
Figure 6:
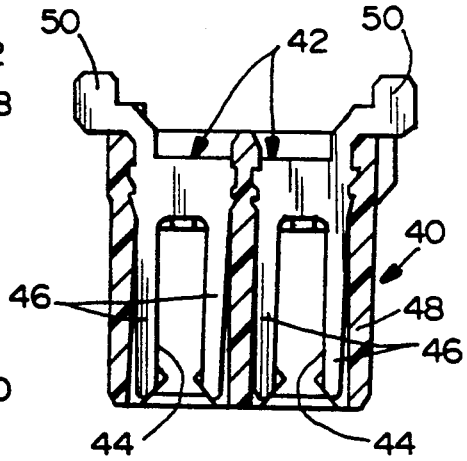
FIG. 6 is a vertical section through a complementary connector for mating with the connector of FIGS. 1–5.
Figure 7:
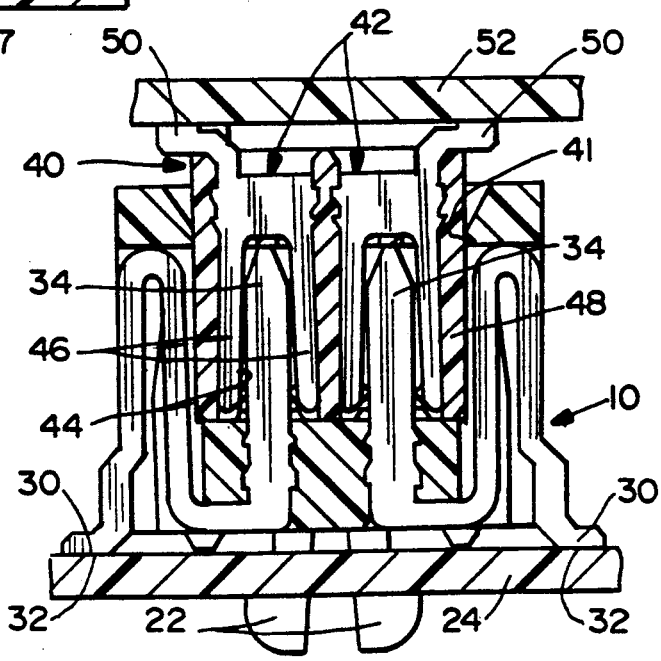
FIG. 7 is a vertical section through the mated connectors of FIGS. 1 and 6.

FIG. 6 shows a complementary electrical connector, generally designated 40, for mating with connector 10, as seen in FIG. 7. More particularly, mating connector 40 is in the form of a plug connector for insertion downwardly into a mouth 41 (FIG. 1) of dielectric housing 12 of connector 10. As seen in FIG. 3, the mouth extends the entire length of the elongated connector 10. It also can be seen in FIG. 3 how the pins defined by terminal portions 34 of contacts 14 project upwardly into mouth 42.

Mating connector 40 (FIG. 6) includes a longitudinal array of pairs of female contacts, generally designated 42, extending lengthwise of the connector. Each female contact 42 has a downwardly opening receptacle 44 between a pair of arms 46 of the contact. Therefore, with terminal pins 34 freely exposed within housing 12, each contact 42 receives a terminal pin 34 of a respective one of contacts 14 of connector 10, the pins being insertable into receptacles 44. Contacts 42 are mounted within a dielectric housing 48 of connector 40. As best seen in FIG. 6, housing 48 of connector 40 is configured to define a plug connector for insertion into mouth 41 of connector 10. Therefore, whereas contacts 42 form female terminals for receiving male terminal pins 34, connector 40 is a plug connector for mating with connector 10 which is a receptacle connector.

FIG. 7 also shows that contacts 42 of mating connector 40 have feet 50 for surface mounting to a second printed circuit board 52. It therefore can be seen in FIG. 7 that the connector system of electrical connectors 10 and 40 is designed, for exemplary purposes, to electrically couple a pair of spaced printed circuit boards 24 and 52.

It should be understood herein and in the claims hereof that various terms have been used representing up-and-down directions to describe the various structural components of the contacts and connectors. This has been done to facilitate a clear and concise description of the invention shown in the drawings. However, any such terms are to be understood as not limiting the invention because the electrical connectors and contacts described and claimed herein are omni-directional in use.

Figure 8:
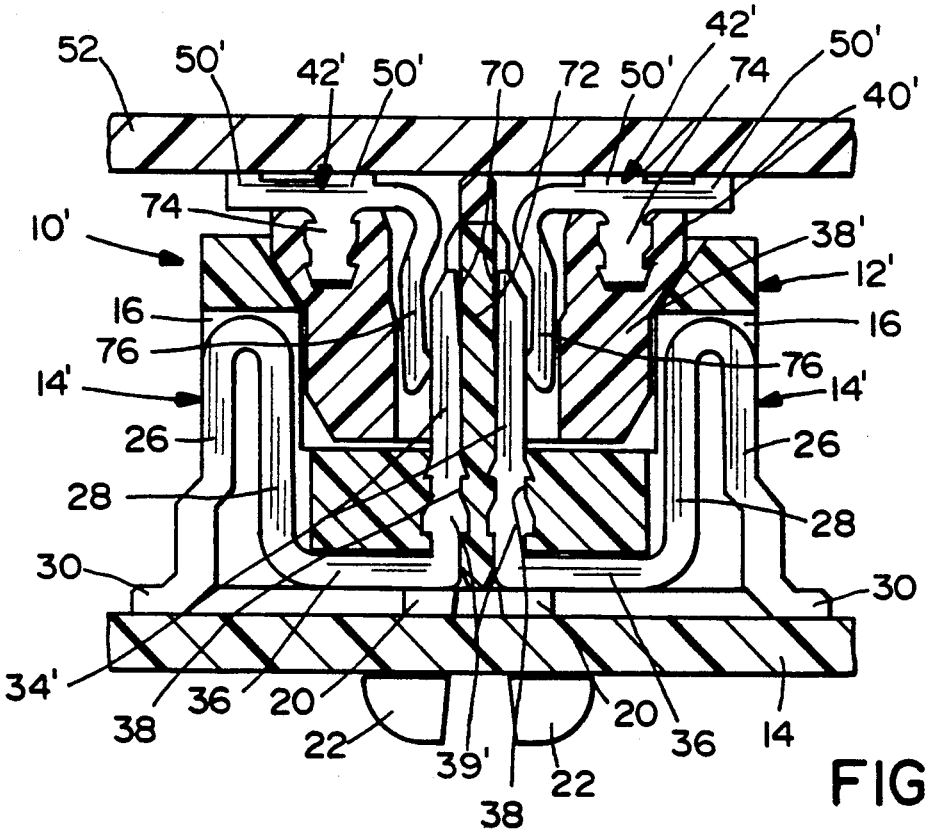
FIG. 8 is a view similar to that of FIG. 7, but showing an alternate form of the invention.
Figure 9:
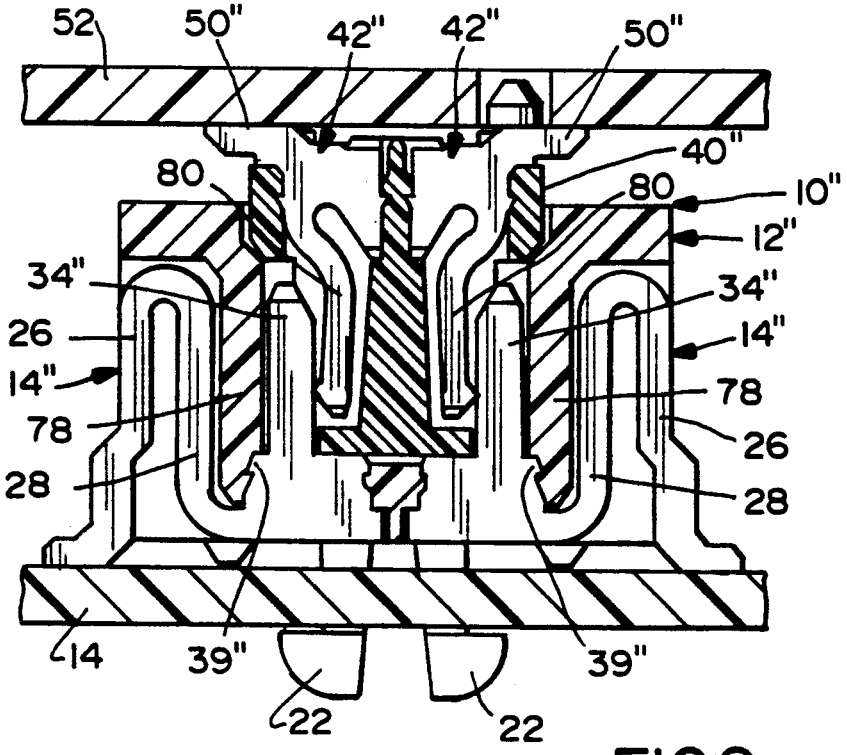
FIG. 9 is a view similar to that of FIGS. 7 and 8, but showing still a further form of the invention.

FIGS. 8 and 9 show alternate forms of the invention wherein the novel contacts and the dielectric housing are designed for engaging mating pin contacts rather than female contacts as described in relation to the embodiment of FIGS. 1–7.

More particularly, referring to FIG. 8, like numerals are applied to like components described in relation to the embodiment of the invention of FIGS. 1–7. Primed numerals or new numerals will be used where the components are different. With that understanding, an electrical connector, generally designated 10', includes an having a pair of electrical terminals or contacts, generally designated 14', mounted therein. Again, the contacts are identical except for their opposite orientations; connector 10' is a multi-terminal connector with housing 12' being elongated and with a series of socket means 16 spaced lengthwise of the housing; and each socket means is provided for receiving a pair of the contacts. The housing is integrally molded of plastic material or the like and includes bifurcated mounting pegs having hook portions 22 at the distal ends of a pair of legs 20 for surface mounting connector 10' to printed circuit board 14.

Each contact 14' again is fabricated as a unitary or one-piece terminal of stamped metal material. Each contact has an inverted U-shaped portion defined by legs 26 and 28, and each leg has a foot portion 30 for surface mounting to an appropriate circuit trace on the printed circuit board. Each contact has a terminal portion 34' turned upwardly from a distal end from the respective leg 28, as by bridging portion 36 The terminal portions include barbs 39' for staking the terminal rigidly within holes 38 in housing 12'.

Up to this point, it is apparent that the general description of contacts 14' is substantially the same as that of contacts 14 in the embodiment of FIGS. 1-7. However, in the embodiment of FIG. 8, it can be seen that inwardly facing or opposing sides 70 of terminal portions 34' are in engagement with opposite sides of a central wall 72 of housing 12'. In other words, contrary to the embodiment shown in FIGS. 1-7 wherein terminal portions 34 are freely exposed within housing 12, terminal portions 34' of contacts 14' in FIG. 8 are supportingly backed by wall 72 of the housing.

Complementary mating connector 40' in FIG. 8 includes a dielectric housing 38', again to form a plug connector for mating with connector 10'. Mating connector 40' has a pair of contacts, generally designated 42' which are staked, as at 74, into housing 38'. Contacts 42' have feet 50' for surface mounting to the second printed circuit board 52.

Contrary to the female-type contact 42 of the embodiment of FIGS. 1-7, contact 42' in FIG. 8 has a terminal pin 76 which, when mating plug connector 40' is inserted into connector 10', the terminal pin engages the outside of a respective terminal portion 34'. Terminal pins 76 are resilient and are maintained in constant contact with terminal portions 43', as wall ' of housing 12' provides supporting backing for terminal portions 34'.

FIG. 9 shows still another embodiment of the invention where, like the embodiment of FIG. 8, the terminal portions are backed by the housing for engaging terminal pins of the mating connector, i.e., again contrary to the mating of a female contact as illustrated in the embodiment of FIGS. 1-7. More particularly, contacts 14" have terminal portions 34" disposed within a housing 12", with the outside surfaces of terminal portions 34" being supportingly backed by walls 78 of the housing. Barbs 39" stake contacts 14" within housing 12".

In the embodiment of FIG. 9, mating connector 40" includes a pair of contacts 42" having feet 50" for surface mounting the connector to second printed circuit board 52. Again, mating connector 40" is a plug connector for insertion-type mating into connector 10". Each contact 42" includes a terminal pin 80 for engaging the inside of a respective one of terminal portions 34". Terminal pins 80 are self-resilient for biasing against terminal portions 34', as walls 78 of housing 12" provide supporting backing for the terminal portions. Otherwise, like numerals have been applied in FIG. 9 corresponding to like components described in relation to the embodiment of FIGS. 1-7 and the embodiment of FIG. 8.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. For use in an electrical connector to be surface mounted to a printed circuit board, an electrical contact comprising an inverted U-shaped portion defining a pair of depending legs, one of the legs having a foot portion for surface mount electrical connection to an appropriate circuit trace on the printed circuit board, and a terminal portion turned upwardly from a distal end of the other leg for termination with an appropriate mating terminal, said terminal portion including a terminal pin for mating with a complementary terminal receptacle.

2. The electrical contact of claim 1 wherein said terminal pin and legs are generally parallel.

3. The electrical contact of claim 1 wherein the electrical contact comprises a unitary component.

4. The electrical contact of claim 1 wherein said pin has a plurality of barbs for staking the contact into an appropriate dielectric housing of the electrical connector.

5. The electrical contact of claim 1 wherein the foot of said one leg has a generally flat bottom surface for surface mounting to the circuit trace on the printed circuit board.

6. The electrical contact of claim 1 wherein the electrical contact comprises a one-piece component of stamped metal.

7. For use in an electrical connector to be surface mounted to a printed circuit board, a one-piece electrical contact comprising an inverted U-shaped portion defining a pair of generally parallel legs, one of the legs having a foot portion for electrical connection to an appropriate circuit trace on the printed circuit board, and a terminal pin turned upwardly from a distal end of the other leg for termination with an appropriate mating terminal, the terminal pin being generally parallel to the legs of the inverted U-shaped portion of the contact.

8. The electrical contact of claim 7 wherein said pin has a plurality of barbs for staking the contact into an appropriate dielectric housing of the electrical connector.

9. The electrical contact of claim 7 wherein the foot of said one leg has a generally flat bottom surface for surface mounting to the circuit trace on the printed circuit board.

10. A surface mountable electrical connector, comprising:

a dielectric housing having at least one terminal receiving socket means; and an electrical contact at least in part disposed in said socket means, including an inverted U-shaped portion defining a pair of depending legs, one of the legs having a foot portion for surface mount electrical connection to an appropriate electronic component, and a terminal portion turned upwardly from a distal end of the other leg for termination with an appropriate mating terminal, said terminal portion being fixed to said dielectric housing and wherein a substantial portion of said inverted U-shaped portion is freely movable relative to the housing whereby the U-shaped portion provides a spring means between the fixed terminal portion and said foot portion electrically connected to the electronic component.

11. The electrical connector of claim 10 wherein said housing includes a plurality of said socket means and said terminals, the socket means being separated by walls which are sufficiently thin to allow limited movement of the terminals transversely of the walls.

12. The electrical connector of claim 10 wherein said terminal portion comprises a terminal pin for mating with a complementary terminal receptacle.

13. The electrical connector of claim 12 wherein said terminal pin and legs are generally parallel.

14. The electrical connector of claim 12 wherein said pin has a plurality of barbs for staking in a hole in the dielectric housing.

15. The electrical connector of claim 12 wherein the foot of said one leg has a generally flat bottom surface for surface mounting to a circuit trace on an appropriate printed circuit board.

16. The electrical connector of claim 12 wherein the electrical contact comprises a one-piece component of stamped metal material.

17. The electrical connector of claim 10 wherein part of said U-shaped portion is exposed to the outside of the dielectric housing.

18. The electrical connector of claim 17 wherein part of said socket means opens to the outside of the dielectric housing, with the other leg of the U-shaped portion being located within the housing and the one leg of the U-shaped portion being exposed to the outside of the housing.

19. The electrical connector of claim 18 wherein said foot projects outwardly of the housing.

20. The electrical connector of claim 10 wherein said housing includes wall means and said terminal portion of the electrical contact comprises a terminal pin engageable on one side thereof with the wall means, with the opposite side of the terminal pin being exposed for termination with the mating terminal.

21. The electrical connector of claim 20 wherein said wall means is generally centrally located of the housing, and including a pair of said electrical contacts with the terminal pins thereof being disposed on opposite sides of the centrally disposed wall means.

22. The electrical connector of claim 20 wherein said wall means include a pair of spaced walls, and including a pair of said electrical contacts with the terminal pins thereof respectively juxtaposed adjacent the spaced walls.

* * * * *